United States Patent [19]

Masuda

[11] 4,448,511

[45] May 15, 1984

[54] ELECTROPHOTOGRAPHIC RECORDING APPARATUS WITH CORONA-DISCHARGE DEVICE HAVING COVER MEANS BETWEEN END OF DISCHARGE WIRE AND ELECTROPHOTOSENSITIVE SURFACE

[75] Inventor: Keiji Masuda, Hachioji, Japan

[73] Assignee: Konishiroku Photo Industry Co., Ltd., Tokyo, Japan

[21] Appl. No.: 328,748

[22] Filed: Dec. 8, 1981

[30] Foreign Application Priority Data

Dec. 18, 1980 [JP] Japan ..... 55-182775

[51] Int. Cl.[3] ..... G03G 15/02

[52] U.S. Cl. ..... 355/3 CH; 250/324; 361/225

[58] Field of Search ..... 355/3 CH; 250/324–326; 361/225, 230, 213, 229

[56] References Cited

U.S. PATENT DOCUMENTS 4,099,219 7/1978 Laing ..... 361/230

4,355,884 10/1982 Honda et al. ..... 355/3 CH

*Primary Examiner*—Richard L. Moses

*Attorney, Agent, or Firm*—Frishauf, Holtz, Goodman and Woodward

[57] ABSTRACT

An electrophotographic recording apparatus comprises an electrophotosensitive member, and a corona discharge device located adjacent the electrophotosensitive surface thereof. The corona discharge device includes a discharge wire spaced from the electrophotosensitive surface, and a covering member for substantially covering the space between the discharge wire and the electrophotosensitive surface at each end of the discharge wire. In some embodiments the covering member spans the space between the discharge wire and the electrophotosensitive surface and contacts the electrophotosensitive surface.

11 Claims, 4 Drawing Figures

ELECTROPHOTOGRAPHIC RECORDING APPARATUS WITH CORONA-DISCHARGE DEVICE HAVING COVER MEANS BETWEEN END OF DISCHARGE WIRE AND ELECTROPHOTOSENSITIVE SURFACE

BACKGROUND OF THE INVENTION

The present invention relates to an improved corona discharge device for an electrophotographic recording apparatus or the like, and more particularly to a corona discharge device including a member for preventing the discharge electrode thereof from being stained by toner or the like.

DESCRIPTION OF THE PRIOR ART

Heretofore, in an electrophotographic recording apparatus or other such apparatus, a corona discharge device has been used by applying high voltage thereto to charge an electrophotosensitive substance, or to transfer a toner image which is visualized on an electrophotosensitive substance onto an image transfer paper and to separate the transfer paper from the electrophotosensitive substance. In the above cases, an ionization current is generated between the surface of the electrophotosensitive substance and the corona discharge device, and an air current is generated from both ends of the electrode of the corona discharge device to the inside of the electrode. Generally the gap between the surface of the electrophotosensitive substance and both ends of the corona discharge device is more than 4 mm. Therefore on account of the air current, toners scattering from a developing device, a cleaning unit or the like, or floating dust is drawn inside the electrode, and consequently they stain a discharge wire or a discharge plate. If a corona discharge device which charges an electrophotosensitive substance is stained, an image transferred on an image transfer paper is blurred or stained. If a corona discharge device is stained for some other reason, the performance thereof is lowered. Therefore, it has been necessary to clean the corona discharged device very often.

SUMMARY OF THE INVENTION

An object of the present invention is to provide an electrophotographic recording apparatus comprising a corona discharge device which is prevented from being stained by toners or the like, and to provide a corona discharge device in which each of the both ends thereof, which are viewed from a direction of an extended discharge wire, is covered by a covering member.

DESCRIPTION OF THE PREFERRED EMBODIMENTS

Figure 1:
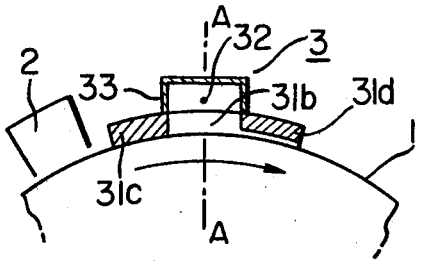
FIG. 1 is a cross-sectional view of one embodiment of the invention taken along line B—B in FIG. 2.
Figure 2:
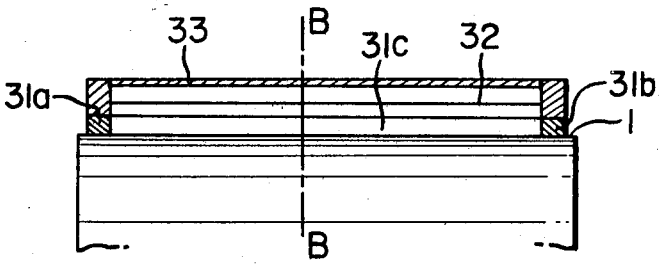
FIG. 2 is a cross-sectional view of the embodiment of FIG. 1 taken along line A-A in FIG. 1, respectively.
Figure 3:
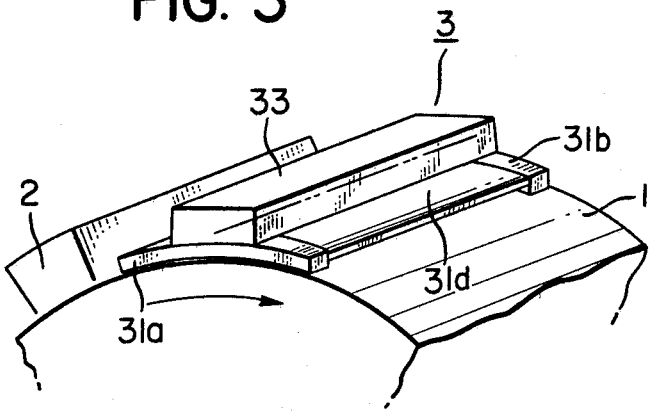
FIG. 3 is a perspective view thereof.

FIG. 1 is a cross-sectional view of the corona discharge device for charging arranged around the photosensitive drum of an electrophotographic copying machine according to the present invention, and is orthogonally viewed to the axis of said drum; FIG. 2 is a cross-sectional view thereof which is viewed in parallel with the drum axis; and FIG. 3 is a perspective view thereof.

The, the numeral 1 indicates a photosensitive drum around which the material such as photoconductive selenium, zinc oxide or the like is provided. The drum 1 is cleaned by cleaning unit 2 and rotates in the direction of the arrow (i.e., the rotation is clockwise in FIG. 1).

Numeral 3 is a corona discharge device of the invention of which the both ends of the discharge electrode have blockshaped covering members 31*a* and 31*b* respectively touching the circumferential surface of photosensitive drum 1. Covering members 31*a* and 31*b* are desirably made of insulating material. The tips of the covering members, at which point the covering members contact the circumferential surface of photosensitive drum 1, may be in the form of a pile weave or may be of urethane rubber so that the circumferential surface of photosensitive drum 1 may not be damaged. If covering members 31*a* and 31*b* are kept out of contact with the circumferential surface of photosensitive drum 1 a the gap of less than 1 mm between them, a similar sealing effect can be obtained so that in the case where they are brought into contact with each other.

Numeral 32 is a single corona wire or a plurality of corona wires made of tungsten and having a diameter of 50–100 μm. The one or more corona wires are arranged so as to make an almost right angle with the moving direction of photosensitive drum 1 between the supporting parts of the corona discharge device provided at the both ends of said wires respectively, and a voltage of several thousands of volts is applied between the wire(s) and the photosensitive substance.

Figure 4:
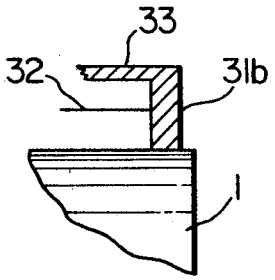
FIG. 4 is a partial cross-sectional view of a modified embodiment.

The supporting parts of the corona discharge device are made of polycarbonate and can be made in one body with the covering members 31*a*, 31*b*, as shown in FIG. 4, which is a view of one side of this modified embodiment, the opposite side being similarly made.

Numeral 33 is a discharge plate made of an electroconductive material such as metal and is in the shape of a box of which the opening part is fixed so as to come close to the circumferential surface of photosensitive drum 1. This enables plate 33 to act as a corresponding electrode.

As described above, it is possible to reduce the stains on an electric charging device greatly and also to reduce the cleaning frequency of the electrodes by means of sealing the both ends of said charge electrode.

Further, the improved effects can be enjoyed not only by providing the covering members 31*a*, 31*b* at the both ends of said electrode, but also by lengthening said covering members in the front and/or rear along the direction of movement of photosensitive drum 1 by for example providing extensions 31*c* and 31*d* (FIG. 1). Generally, a cleaning unit is provided up stream as viewed in the direction of movement of a electrophotosensitive substance. Therefore it is more effective to lengthen said covering members 31*a*, 31*b* in the front or upstream direction. However, after the electric charge is applied by the corona wire 32 (on the side of 31*d*), the voltage of the circumferential surface of the photosensitive substance is at 1,000 V or thereabouts, and accordingly it is necessary to provide a gap between rear or downstream covering member extension 31*d* and the circumferential surface of photosensitive drum 1. Through experiments, it has been found preferable to adjust the gap to said order of 1 mm.

What is claimed is:

1. An electrophotographic recording apparatus, comprising:

an electrophotosensitive means having an electrophotosensitive surface;

a corona discharge device located adjacent said electrophotosensitive surface, said corona discharge device including at least one elongated discharge wire spaced from said electrophotosensitive surface and extending along a dimension of said electrophotosensitive surface, said discharge wire having opposite ends;

said electrophotosensitive surface being movable relative to said corona discharge device; and said corona discharge device including covering means at least at each end of said discharge wire for substantially covering the space between said discharge wire and said electrophotosensitive surface at each end of said discharge wire, said covering means extending from said discharge wire and extending toward said electrophotosensitive surface, said covering means having contact portions contacting with said electrophotosensitive surface.

2. The electrophotographic recording apparatus of claim 1 wherein said covering means has lengthened portions extending in the upstream direction as viewed in the direction of said relative movement of the electrophotosensitive surface, said lengthened portions being in the vicinity of said ends of said discharge wire.

3. The electrophotographic recording apparatus of claim 1 or 2 wherein said covering means has lengthened portions extending in the downstream direction as viewed in the direction of said relative movement of the electrophotosensitive surface, said lengthened portions being in the vicinity of said ends of said discharge wire.

4. The electrophotographic recording apparatus of claim 3 wherein said covering means further includes extensions along the electrophotosensitive surface between said lengthened portions.

5. The electrophotographic recording apparatus of claim 1 wherein said corona discharge device further includes a supporting part at each end of said at least one discharge wire for supporting said at least one discharge wire, said covering means being integrally formed with respective supporting parts.

6. The electrophotographic recording apparatus of claim 1 wherein said contact portions comprise pile weave material.

7. An electrophotographic recording apparatus, comprising:

an electrophotosensitive means having an electrophotosensitive surface a corona discharge device located adjacent said electrophotosensitive surface, said corona discharge device including at least one elongated discharge wire spaced from said electrophotosensitive surface and extending along a dimension of said electrophotosensitive surface;

said electrophotosensitive surface being movable relative to said corona discharge device; and said corona discharge device including covering means for substantially covering the space between said discharge wire and said electrophotosensitive surface at each end of said discharge wire;

said covering means having contact portions of pile weave material contacting with the electrophotosensitive surface in the vicinity of the ends of said discharge wire.

8. The electrophotographic recording apparatus of claim 7 wherein said covering means has lengthened portions extending in the upstream direction as viewed in the direction of said relative movement of the electrophotosensitive surface, said lengthwise portions being in the vicinity of said ends of said discharge wire.

9. The electrophotographic recording apparatus of claim 7 or 8 wherein said covering means has lengthened portions extending in the downstream direction as viewed in the direction of said relative movement of the electrophotosensitive surface, said lengthened portions being in the vicinity of said ends of said discharge wire.

10. The electrophotographic recording apparatus of claim 9 wherein said covering means further includes extensions along the electrophotographic surface between said lengthened portions.

11. The electrophotographic recording apparatus of claim 7 wherein said corona discharge device further includes a supporting part at each end of said at least one discharge wire for supporting said at least one discharge wire, said covering means being integrally formed with respective supporting parts.

* * * * *